US012807291B1

(12) United States Patent
Snyder et al.

(10) Patent No.: US 12,807,291 B1
(45) Date of Patent: Nov. 24, 2026

(54) MARINE STEERING AND TRIM SYSTEM AND CONTROL METHOD

(71) Applicant: Brunswick Corporation, Mettawa, IL (US)

(72) Inventors: Matthew W. Snyder, Fond du Lac, WI (US); Kenneth G. Gable, Oshkosh, WI (US); Conor A. Leehaug, Appleton, WI (US)

(73) Assignee: Brunswick Corporation, Mettawa, IL (US)

( * ) Notice: Subject to any disclaimer, the term of this patent is extended or adjusted under 35 U.S.C. 154(b) by 8 days.

(21) Appl. No.: 18/940,368

(22) Filed: Nov. 7, 2024

(51) Int. Cl.
*B63H 20/12* (2006.01)
*B63H 20/00* (2006.01)
*B63H 20/10* (2006.01)

(52) U.S. Cl.
CPC ..... *B63H 20/12* (2013.01); *B63H 20/10* (2013.01); *B63H 2020/003* (2013.01)

(58) Field of Classification Search
None
See application file for complete search history.

(56) References Cited

U.S. PATENT DOCUMENTS

| | | | | |
|---|---|---|---|---|
| 11,235,847 | B1 | 2/2022 | Malouf et al. | |
| 11,347,223 | B1 | 5/2022 | Belter et al. | |
| 11,370,521 | B1 * | 6/2022 | Arbuckle | B63H 20/12 |
| 11,586,207 | B1 | 2/2023 | Belter et al. | |
| 11,673,633 | B1 * | 6/2023 | Arbuckle | B63H 21/21 701/21 |
| 11,772,766 | B2 | 10/2023 | Malouf et al. | |
| 11,932,370 | B1 | 3/2024 | Arbuckle et al. | |
| 12,030,607 | B1 | 7/2024 | Kirchhoff et al. | |
| 2016/0068247 | A1 * | 3/2016 | Morvillo | B63H 20/08 701/21 |
| 2022/0009611 | A1 * | 1/2022 | Malouf | B63H 20/12 |
| 2022/0144401 | A1 * | 5/2022 | Malouf | B63H 20/12 |

* cited by examiner

*Primary Examiner* — Imran K Mustafa
*Assistant Examiner* — David Hatch
(74) *Attorney, Agent, or Firm* — Andrus Intellectual Property Law, LLP

(57) ABSTRACT

A marine propulsion system is configured to detect that at least one of a plurality of drives is running and that at least one drive is not operating, including not running and/or not steerable, detect a trim position of each of the at least one non-operating drive and determine whether the at least one non-operating drive trimmed up. If the non-operating drive is not trimmed up, a restricted steering angle range is determined for each of the plurality of drives to avoid drive collision between the running drive and the non-operating drive. If the at least one non-operating drive is trimmed up, a wide steering angle range is determined for each of the at least one running drive. Steering actuators for each of the plurality of drives are controlled based on the restricted steering angle range or the wide steering angle range.

20 Claims, 10 Drawing Sheets

MARINE STEERING AND TRIM SYSTEM AND CONTROL METHOD

FIELD

The present disclosure relates to methods and systems for controlling steering and trim of a marine vessel, and specifically methods and systems for controlling steering and trim of a marine vessel involving two or more marine drives when only a subset of the marine drives is running.

BACKGROUND

The following U.S. patents and patent applications are hereby incorporated herein by reference.

U.S. Pat. No. 11,235,847 discloses a method of controlling a marine drive on a marine vessel includes receiving a trim position instruction to adjust a trim position of the marine drive and determining an allowable steering angle range based on the trim position instruction or adjusted trim position of the marine drive. A trim actuator is controlled to adjust the trim position of the marine drive based on the trim position instruction and a steering actuator is controlled to automatically adjust steering position of the marine drive to remain within the allowable steering range.

U.S. Pat. No. 11,673,633 discloses a method of controlling a plurality of marine drives on a marine vessel includes detecting that at least one of the plurality of marine drives and that at least one of the plurality of marine drives is not running, and then determining, based on the trim position of each of the at least one non-running marine drives, that at least one non-running marine drive is trimmed down. If so, an output limit restriction is effectuated for each of the at least one running marine drive and an alert is generated to advise an operator of the output limit restriction.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the present disclosure, a marine propulsion system includes a plurality of marine drives and a control system configured to detect that at least one of the plurality of marine drives is running and that at least one of the plurality of marine drives is not functioning by not running and/or not being steerable. The control system is further configured to detect a trim position of each of the at least one non-operating marine drive and determine whether the at least one non-operating marine drive trimmed up. If the non-operating marine drive is not trimmed up, a restricted steering angle range is determined for each of the plurality of marine drives to avoid drive collision between the running marine drive and the non-operating marine drive. If the at least one non-operating marine drive is trimmed up, a wide steering angle range is determined for each of the at least one running marine drive. Steering actuators for each of the plurality of marine drives are controlled based on the restricted steering angle range or the wide steering angle range.

In one embodiment, the detected trim position is at least a threshold trim position, wherein the threshold trim position is defined such that the non-operating marine drive is high enough to allow an adjacent marine drive to steer under the non-operating marine drive without collision.

In another embodiment, the threshold trim position associated with the marine drive being out of the water.

In another embodiment, the detected trim position is a threshold trim position defined based a maximum trim position of the marine drive.

In another embodiment, determining the restricted steering angle range for each of the plurality of marine drives includes determining a different range for each of the plurality of marine drives based on a starboard or port position of each respective marine drive.

In another embodiment, the restricted steering angle range for each of the plurality of marine drives includes a port outer restricted steering angle range for the port outer drive and a starboard outer restricted steering angle range for the starboard outer drive.

In another embodiment, the port outer restricted steering angle range and the starboard outer restricted steering angle range are different from one another and at least one of the port outer restricted steering angle range and the starboard outer restricted steering angle range are asymmetric about a centered steering position.

In another embodiment, the port outer restricted steering angle range is more restrictive in the starboard direction than the port direction, wherein the starboard outer restricted steering angle range is more restrictive in the port direction than the starboard direction.

In another embodiment, the restricted steering angle range and the wide steering angle range for each of the at least one running marine drive is based on a starboard or port position of the at least one non-operating marine drive on a stern the marine vessel and a number of drives on the marine vessel.

In another embodiment, the wide steering angle range is wider than the restricted steering angle range in at least one steering direction.

In another embodiment, the wide steering angle range for each of the at least one running marine drive extends under the non-operating marine drive that is trimmed up.

In another embodiment, the control system is further configured to prevent trim down of a non-operating marine drive when the marine vessel is above a threshold vessel speed and/or when any of the marine drives are above a threshold drive RPM.

In another embodiment, the control system is configured to, in response to receiving an instruction to trim down the non-operating marine drive, prevent trim down of the non-operating marine drive if any adjacent running marine drive to the non-operating marine drive is steered to a position within the wide steering angle range that is under the non-operating marine drive.

In another embodiment, the control system is further configured to prevent trim down of the non-operating marine drive if any adjacent marine drive to the non-operating marine drive has a steering sensor fault.

In another aspect of the present disclosure, a method of controlling a plurality of marine drives on a marine vessel includes detecting that at least one of the plurality of marine drives is running and that least one of the plurality of marine drives is not operating, wherein not operating includes not running and/or not steerable. The control method further includes detecting a trim position of each of the at least one non-operating marine drive, and determining, based on the trim position, whether the at least one non-operating marine drive trimmed up. If the at least one non-operating marine drive is not trimmed up, a restricted steering angle range is determined for each of the plurality of marine drives to avoid drive collision between the running marine drive and the non-operating marine drive. If the at least one non-operating marine drive is trimmed up, a wide steering angle range is determined for each of the at least one running marine drive. A steering actuator for each of the plurality of marine drives is controlled based on the restricted steering angle range or the wide steering angle range for the respective marine drive.

In one embodiment, the detected trim position is at least a threshold trim position.

Optionally, the threshold trim position is defined such that the non-operating marine drive is high enough to allow an adjacent marine drive to steer under the non-operating marine drive without collision.

Optionally, the threshold trim position is defined such that the non-operating marine drive is trimmed out of the water.

Optionally, the threshold trim position is defined with respect to a maximum trimmed up position of the marine drive, such as to require that the marine drive is within a threshold of the maximum trim position.

In another embodiment, determining the restricted steering angle range for each of the plurality of marine drives includes determining a different range for each of the plurality of marine drives based on a starboard or port position of each respective marine drive.

In another embodiment, the restricted steering angle range and the wide steering angle range for each of the at least one running marine drive is based on a position of the at least one non-operating marine drive on the marine vessel and a number of drives on the marine vessel.

In another embodiment, the wide steering angle range is wider than the restricted steering angle range in at least one steering direction, wherein the wide steering angle range for each of the at least one running marine drive extends under the non-operating marine drive that is trimmed up.

In another embodiment, the method further includes preventing trim down of a non-operating marine drive when the marine vessel is above a threshold vessel speed and/or when any of the marine drives are above a threshold drive RPM.

In another embodiment, in response to receiving an instruction to trim down the non-operating marine drive, preventing trim down of the non-operating marine drive if any adjacent marine drive to the non-operating marine drive is steered to a position within the wide steering angle range that is under the non-operating marine drive or if any adjacent marine drive to the non-operating marine drive has a steering sensor fault.

Various other features, objects and advantages of the invention will be made apparent from the following description taken together with the drawings.

BRIEF DESCRIPTION OF THE FIGURES

The Figure is a schematic depiction of a marine vessel incorporating one example of architecture according to the present disclosure.

DETAILED DESCRIPTION

Figure 1:
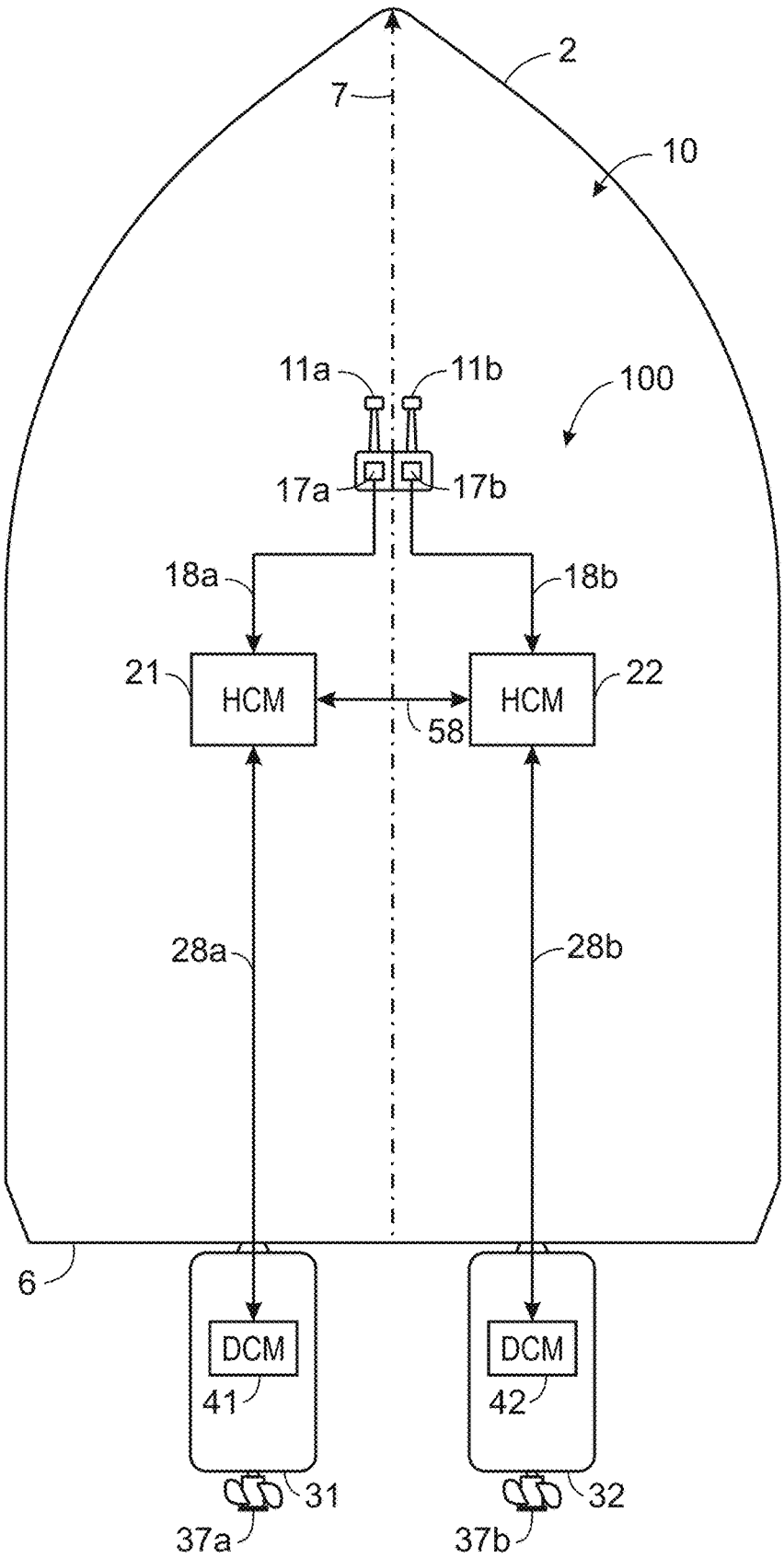
FIG. 1 depicts one embodiment of a propulsion system on a marine vessel.

The present inventors have recognized a problem with certain multi-drive propulsion systems relating to situations where only a subset of the plurality of marine drives is running and one or more of the drives is not running and/or is not steerable while the vessel is underway. This may occur where, for example, an operator keys on only a subset of the drives to propel the marine vessel at a relatively slow speed, such as to exit a marina. An operator may intentionally operate only a portion of the drives on a vessel to minimize wear on the drives, save fuel, etc. Additionally, a subset of the plurality of marine drives on a vessel may not be running if one or more of the marine drives encounters a problem such that it is not operable or should not be operated due to a fault condition. A non-running drive is one where the powerhead (e.g., an internal combustion engine or electric motor configured to generate propulsion) is not turning, which may be due to a fault condition or problem or may be a result of the above-described user selection to operate a subset of the drives. Alternatively or additionally, one or more of the marine drives may not be steerable such that it cannot be steered in response to a steering command, such as due to a malfunction or other fault with the steering actuator, steering sensor, or other aspect of the steering system, or due to the respective drive not being keyed on or otherwise activated.

When only a subset of the drives on a marine vessel is operated, the non-functioning subset of drives may remain trimmed down while the vessel is underway, remaining trimmed down to a normal operating trim position such that the propeller of the non-operating drive remains in the water. The presence of the non-operating drives in the water reduces the steerability of the marine vessel because the non-operating drives provide no thrust and/or are not steerable in response to a steering command. The steering range of the running drives in the system may need to be reduced to avoid or prevent drive collision where the non-operating marine drive is not being steered normally and otherwise to compensate for the abnormality and/or asymmetry caused by the non-operating drive(s). Steering limits may be imposed on all of the marine drives, or at least those adjacent to the non-operating marine drive(s), to prevent drive collision where the non-operating marine drive is not being steered normally.

The inventors have recognized that imposing steering limits on the marine drives may impact drivability, particularly if a user is operating for long distances while steering limited. The inventors have recognized that, once a non-operating marine drive is trimmed up out of the water and thus out of the way of the other drives, steering limits can be lifted to increase drivability. Moreover, the inventors have recognized that where one or more of the drives is trimmed up, additional steering authority can be granted beyond what is normally provided when that drive is trimmed down. This is because, with few drives occupying the water surface behind the vessel, the risk of collision between adjacent drives is reduced. The disclosed system and method restricts the steering angle range until the non-operating drives are trimmed out of the water, and then increases the steering angle range of the running drives beyond the normal steering range permitted when all drives are running. This improves the steerability of the marine vessel. Further still, the inventors have recognized that increasing allowable steering ranges while the drives are trimmed up could lead to drive collision when the non-operating drive is trimmed down and thus have devised additional logic to avoid drive collision when trimming a trimmed up marine drive back down into the water.

Figure 2:
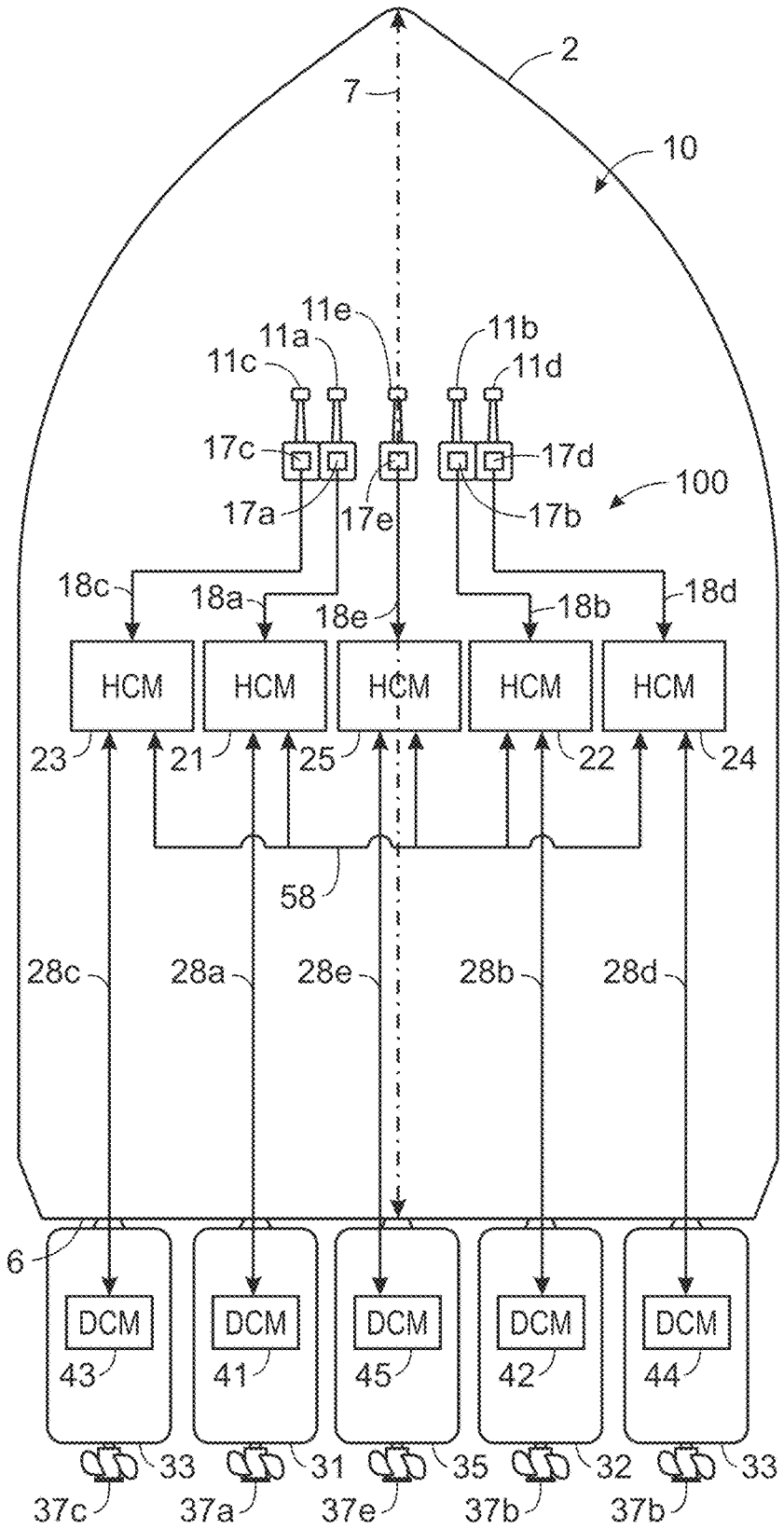
FIG. 2 depicts another embodiment of a propulsion system on a marine vessel.

FIGS. 1 and 2 illustrate a marine vessel 2 having a propulsion system 10 for controlling propulsion in accordance with the present disclosure. The propulsion system 10 includes a plurality of marine drives (31 and 32 FIGS. 1 and 31-35 in FIG. 2), which in the depicted embodiments are outboard motors coupled to the transom 6 of the marine vessel 2. The marine drives 31-35 are attached to the marine vessel 2 in a conventional manner such that each is rotatable about a respective vertical steering axis to steer the marine vessel 2 and is rotatable about a horizontal trim axis to trim the drives up and down. In the examples shown and described, the marine drives 31 and 32 (and 31-35 in FIG. 2) are outboard motors; however, the concepts of the present disclosure are not limited to use with outboard motors and can be implemented with other types of marine drives, such as stern drives.

In the examples shown and described, the marine drives have a powerhead that causes rotation of the drive shaft to thereby cause rotation of a propeller shaft having a propeller 37 at the end thereof, which will be understood as referring to a propeller or an impeller, or combination thereof. The disclosed concepts and configurations may be equally applicable to marine drives having electric motor powerheads or to marine drives with internal combustion engine (ICE) powerheads, or any combination thereof. The propeller 37 is connected to and rotates with the propeller shaft propels the marine vessel 2. The direction of rotation of the propeller 37 may be changeable by a gear system (e.g., a transmission), which has a forward gear associated with a forward thrust caused by a first rotational direction and a reverse gear associated with a backward thrust caused by the opposite rotational direction. In some implementations, a gear system (e.g., a transmission) is may be positioned between the forward gear, a neutral state (no thrust output), and the reverse gear, and/or between multiple different forward or reverse gear positions that adjust the translation ratio of the powerhead rotation to the propulsor. Such positioning is typically controlled by a user-operated a remote control 11 (FIGS. 1-3) associated with the respective marine drive 31-35. As is conventional, the remote control 11 includes a lever 50 (FIG. 3) movable by an operator into a reverse position at causes the gear system to shift into reverse gear, a neutral position that causes the gear system to shift into a neutral state, and a forward position that causes the gear system to shift into forward gear. The remote control lever 50 is also movable by an operator to provide throttle control, and thus thrust control, within the respective gear position.

The propulsion system includes a control system 100 that includes one or more controllers and communication networks for effectuating propulsion control, such as based on user input. Referring to FIG. 1, each marine drive 31, 32 is controlled by a respective helm control module (HCM) or command control module (CCM) 21, 22, which is communicatively connected to a drive control module (DCM) 41, 42 for that respective marine drive 31, 32. The connection between the HCM 21, 22 and the DCM 41, 42 is via a communication link 28*a*, 28*b*, respectively, which in may be by any known means and in various embodiments could be a CAN bus for the marine vessel, a dedicated communication bus between the respective control modules 21 and 41, 22 and 42, via a wireless communication protocol, or via other communication means implemented for facilitating communication between electronic devices on a marine vessel. The first HCM 21 and the second HCM 22 are communicatively connected via communication link 58 so that information can be exchanged therebetween, which may also be by any known means including via CAN. In certain embodiments, the HCMs 21 and 22 may communicate instead via the same communication link 28 that facilitates communication with the DCMs 41 and 42.

Thereby, communication is facilitated between the HCMs and the DCMs, whereby the DCM communicates communicate powerhead parameters—e.g., powerhead state (stall, crank, or run), rpm, throttle position, transmission speed, etc.—and the HCM can communicate control instructions—e.g. output commands based (such as based on user inputs to control throttle, steering, and/or trim). In other embodiments, the methods and systems described herein may be accomplished by the DCMs 41 and 42 associated with the respective marine drives 31 and 32 without the involvement of HCMs or other additional control modules, and in such an embodiment the DCMs 41 and 42 may be connected by any wired or wireless communication link as described above.

Each HCM 21, 22 is communicatively connected to a remote control 11*a*, 11*b* for controlling the operation of the respective marine drive 31, 32. In another embodiment, both marine drives 31 and 32 are controlled by a single remote control 11 communicatively connected to both HCMs 21, 22 such that the throttle request is the same for the two drives and the throttles are not separately controllable by an operator. In a preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein by reference.

The control system 100 arrangement depicted and described at FIGS. 1 and 2 is merely representative and various other arrangements are known and within the scope of the disclosure. For example, each drive may comprise two or more controllers, such as a powertrain control module (PCM) and a thrust vector module (TVM), as is well-known in the art. In other control system 100 arrangements, a central control module may be provided in addition to or in place of the HCMs 22, 23.

Figure 3:
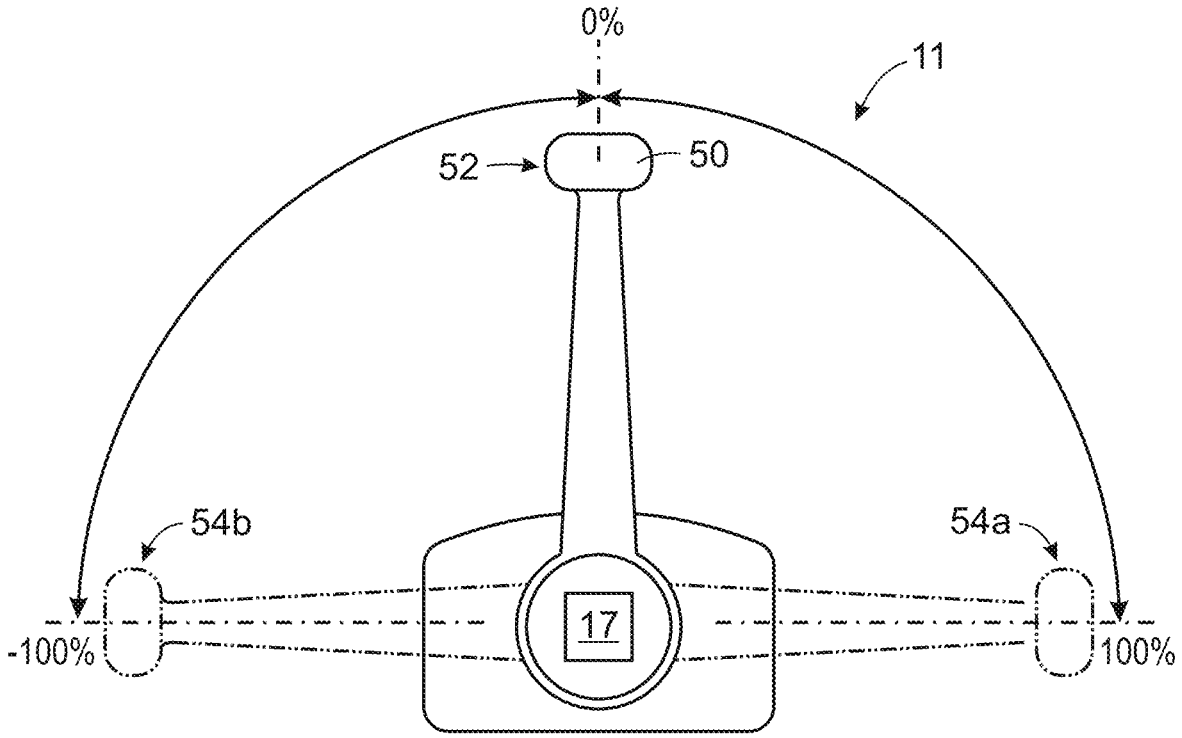
FIG. 3 illustrates one embodiment of a remote control for a system for controlling propulsion of a marine vessel.

As shown in FIG. 3, each remote control 11 has a lever 50 positionable between a neutral lever position 52 associated with an idle and a neutral position of the gear system, and a full forward lever position 54*a* and a full reverse lever position 54*b*. The full throttle lever positions 54*a*, 54*b* are associated with an output value, such as engine RPM or maximum power output value. For example, lever position may be mapped to an RPM setpoint and airflow and power output are thus controlled accordingly to run the powerhead at that RPM. The position of the lever 50 is determined by the position sensor 17 providing an analog output or a digital output of angular position to a respective helm control module 21, 22. The position of the lever 50 may be expressed as a percent of the range of motion of the lever 50 in the respective direction—i.e., between 0% and +100% in the forward position and between 0% and −100% in the reverse direction. Each lever position between 0% and 100% is determined by the respective HCM 21, 22 to provide a throttle control command to control the throttle valve to provide a corresponding power output. For instance, a lever position of 50% corresponds with throttle control to provide 50% power output. For example, the position sensor 17 may be a programmable magnetic encoder, a clinometer, a Hall Effect sensor, a potentiometer, a rotary encoder, or the like.

On a vessel with a plurality of marine drives, the marine drives are generally positioned symmetrically about a centerline 7 of the marine vessel 2 so that the forces on the marine vessel balance and no appreciable net torque on the marine vessel is created when the marine drives 31 and 32 are in the straight ahead position—i.e., when the force created by the propulsor 37*a*-37*e* for the marine drive 31-35 is in the straight ahead direction parallel with the centerline 7. Accordingly, a marine vessel 2 equipped with two marine drives 31 and 32 (FIG. 1) has the marine drives positioned equidistant from the centerline 7. Similarly, when additional marine drives are added to the system, they are positioned so that no net torque is provided when all marine drives are in the straight ahead position. Accordingly, a third marine drive added to the system would be added along the centerline 7 of the marine vessel. FIG. 2 illustrates this concept, having five marine drives 31-35 positioned symmetrically about the centerline 7. Specifically, the first marine drive 31 and the second marine drive 32 are positioned on the inner port side and inner starboard side, respectively, about the centerline 7. The third marine drive 33 and fourth marine drive 34 are positioned on the outer port side and outer starboard side, respectively, and equidistant from the centerline 7. The fifth marine drive 35 is positioned in the center along the transom 6.

Similar to the system described above with respect to FIG. 1, the system depicted in FIG. 2 includes a helm control module 21-25 for each marine drive 31-35, which is communicatively connected via communication link 28*a*-28*e* to the drive control module 41-45 for each marine drive 31-35. Additionally, in the embodiment of FIG. 2, each marine drive 31-35 has an associated remote control 11*a*-11*e* having a position sensor 17*a*-17*e* as described above, such that the output power, or thrust, can be controlled by a user. Each remote control 11*a*-11*e* is connected to the HCM 21-25 for the respective marine drive 31-35 via communication link 18*a*-18*e*, which as described above may be a CAN bus, a dedicated communication bus, or a wireless communication link. In certain embodiments, the communication links 18*a*-18*e* may be the same CAN bus as the communication links 58, and/or the same bus as communication links 28*a*-28*e*.

Figure 4:
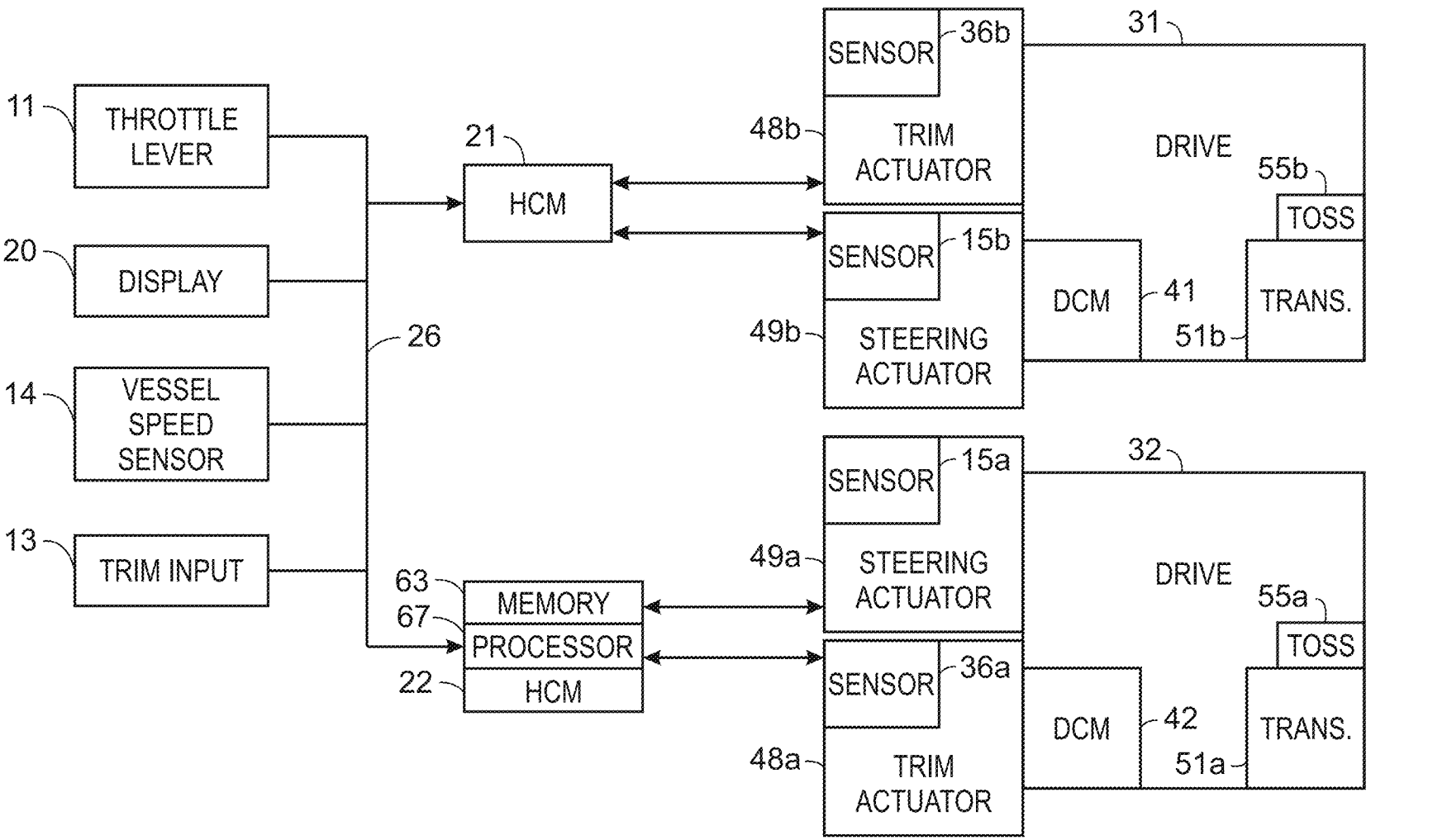
FIG. 4 is a schematic exemplifying one embodiment of a marine propulsion system and control system for controlling a plurality of marine drives according to the present disclosure.

Referring now to FIG. 4, the propulsion system 10 further includes a trim actuator 48 and a steering actuator 49*a*, 49*b* associated with each drive 31-32 (or 31-35). In the depicted example, each HCM 21 and 22 is communicatively connected (e.g., via the CAN bus arrangement 28*a*, 28*b*) and configured to control the trim actuators 48 and steering actuators 49*a*, 49*b*; however, various other control arrangements are possible and well known in the relevant art. The trim actuators 48*a*, 48*b* move the marine drives 31 and 32 to a commanded trim position, e.g., in response to signals sent from the HCMs 21, 22. For example, such commands may be based on input from the user via a trim control input device 23 (e.g., trim control buttons). Further, the system 10 comprises trim angle sensors 36*a*, 36*b* for sensing current trim positions of each marine drive 31, 32. The propulsion system 10 further includes a steering actuator 49*a*, 49*b* for each marine drive 31 and 32, where each steering actuator 49*a*, 49*b* is configured to rotate the marine drive 31, 32 about its respective steering axis. In some arrangements, the steering actuators 49*a*, 49*b* are electric actuators or electric over hydraulic actuators powered by the battery of the marine drive 31, 32 that it is being steered. Steering sensors 15*a* and 15*b* are each configured to sense the current steering position of a respective marine drive 31, 32; this data is provided by the system 10 to the control modules via the CAN bus 26.

Now referring to FIGS. 5-8, various trim positions of the marine drives 31, 32 (or 31-35) will be described. In the example shown in FIGS. 5-8, only the starboard marine drive 32 is shown. However, it should be understood that all of the plurality of marine drives are movable between a minimum trim position where the drive is fully trimmed down and a maximum trim position where the drive is fully trimmed up, as shown in these figures. It should also be understood that the trim position of each marine drive 31, 32 (or 31-35) are separately controllable.

Figure 5:
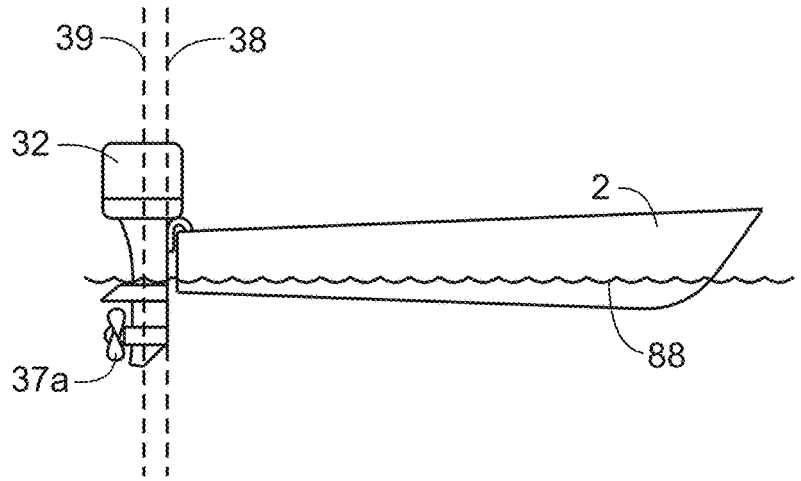
FIG. 5 is a side view of a marine vessel having a marine drive in a trimmed down position which is a vertical trim position.
Figure 6:
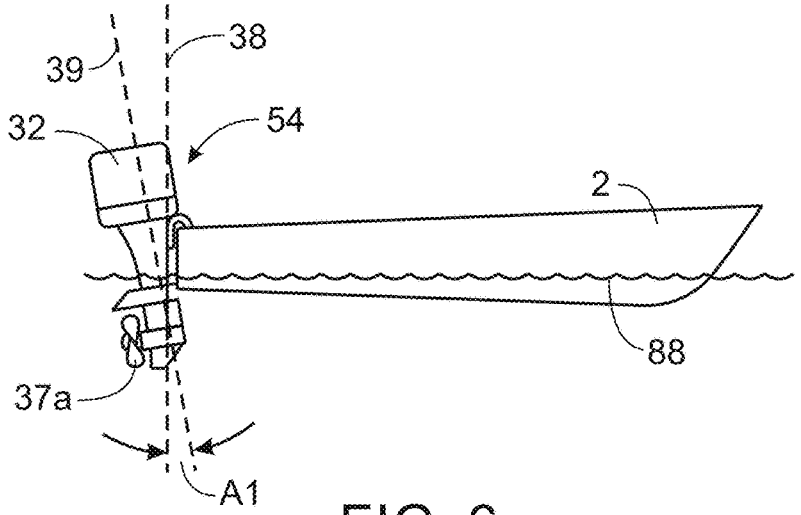
FIG. 6 is a side view of a marine vessel having a marine drive in a minimum trim position where the drive is fully trimmed down.

In each of FIGS. 5-8 the trim position of the marine drive 31, 32 is shown with respect to a dashed line representing a vertical axis 38. Additionally, another dashed line in each of the figures represents a longitudinal axis 39 through the marine drive 32. The angle between the vertical axis 38 and the longitudinal axis 39 is the trim angle A. In FIG. 5, the marine drive 32 is in a neutral trim position in which the vertical axis 38 and the longitudinal axis 39 are generally parallel to one another. In FIG. 6, the marine drive 32 is trimmed all the way down (or fully trimmed in) such that a propeller 37*b* of the marine drive 32 is closer to the hull of the marine vessel 2 than when the marine drive 32 is in the neutral trim position. In the fully trimmed down position, the marine drive 32 is angled such that the propeller 37*b* is closer to the hull of the marine vessel 2 than when in the neutral position, and its longitudinal axis 39 is oriented at an angle A1 with respect to the vertical axis 38. This position is sometimes referred to as "full tuck."

Figure 7:
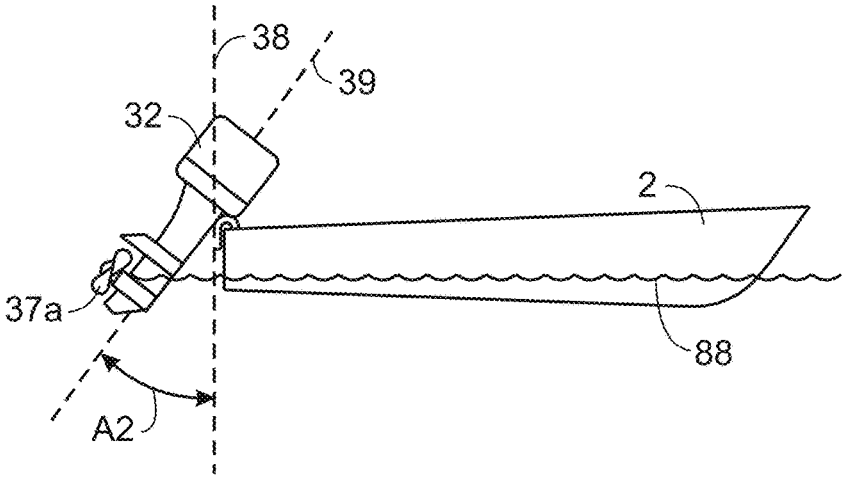
FIG. 7 is a side view of a marine vessel having a marine drive in a trimmed up position.
Figure 8:
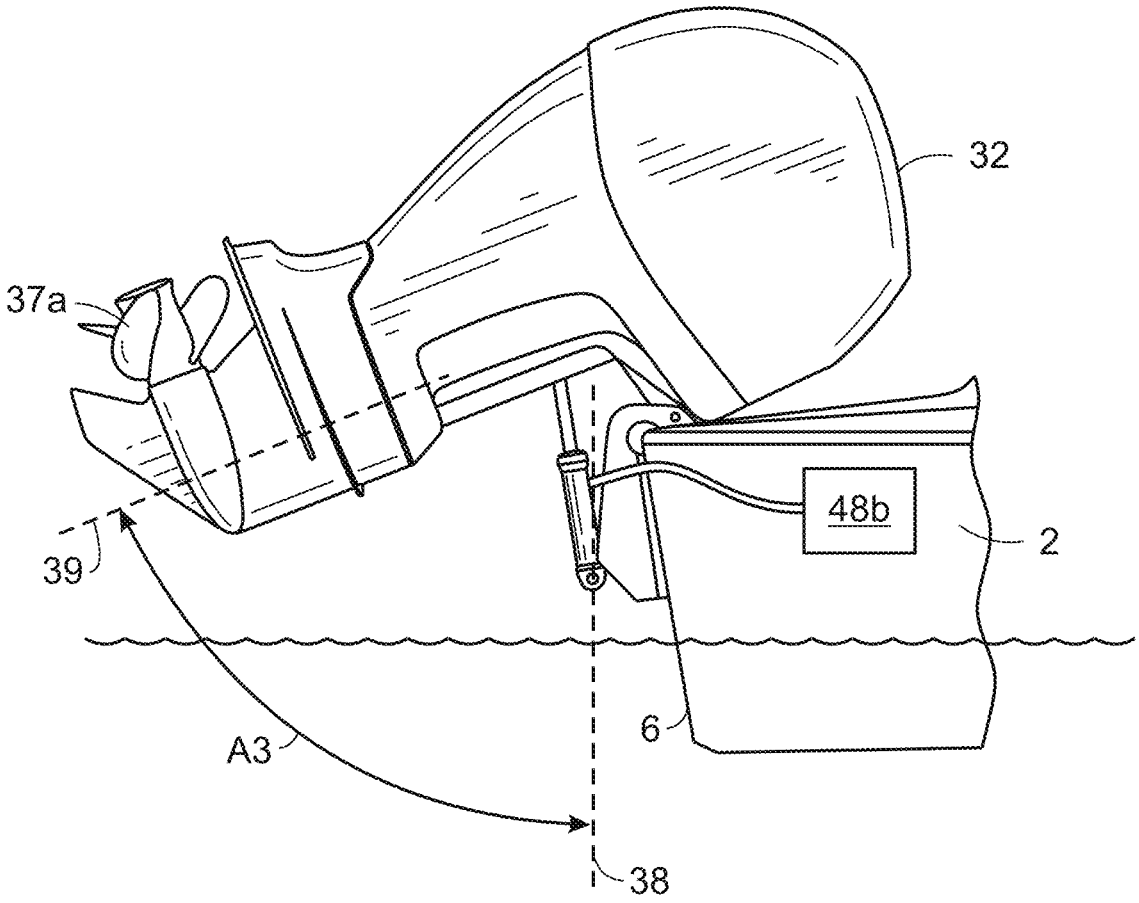
FIG. 8 is a side view of a marine vessel having a marine drive in a maximum trim position where the drive is fully trimmed up.

In FIG. 7 the marine drive 32 is partially trimmed up (trimmed out) such that the propeller 37*a* is further from the hull. Here, the propeller 37*b* of the drive 32 is at or near the water surface 88. The longitudinal axis 39 extends at an angle A2 with respect to the vertical axis 38. To provide just one example, the angle A2 may be around 30 degrees of trim, which in various embodiments may be greater or less depending on the vessel configuration, drive configuration, etc. For trim positions above, or greater than, that point, the propeller will be out of the water, particularly if the vessel is sitting at dock or idling. FIG. 8 is a closer depiction of the drive 32 trimmed up even further, which may represent a trim angle A3 that indicates a maximum trim position where the marine drive 32 is fully trimmed up and is lifted out of the water. Sometimes the range of trim positions between the trim position shown in FIG. 7 where the drive is trimmed to a maximum position that maintains the propulsor in the water and the position shown in FIG. 8 where the drive is timed fully out of the matter, such as for trailering or storage, is referred to as the "tilt range." Preferably, non-operating marine drives are placed in this position, or at least above the position shown in FIG. 7 such that the propeller of the non-operating drive is fully out of the water. In this position, the drive 32 is lifted out of the water so that the propeller is not rotated (so as not to rotate the transmission), and/or so that it does not create drag, limit steering angles of neighboring drives, and is otherwise out of the way.

Returning to FIG. 4, an exemplary propulsion system 10 is shown. As described hereinabove, the control system 100 may receive input from a throttle lever 50, vessel speed sensor 14, display 20, trim input 13 (e.g., trim control buttons) (collectively, the user input devices) communicatively connected (e.g. via CAN bus 28) to one or more controllers, such as HCMs 21, 22. The HCMs 21, 22 interpret these signals and send commands to the trim actuators 48*a* and 48*b*, the marine drives 31, 32, etc. Trim control input 13 may be configured to receive user inputs to adjust trim position of one or more of the marine drives (e.g., 31-35), and preferably the trim control input 13 is configured such that the user separately controls the trim position of each drive. The vessel speed sensor 14 may be, for example, a pitot tube sensor, a paddle wheel sensor, or any other speed sensor appropriate for sensing the actual speed of the marine vessel. Alternatively or additionally, the vessel speed sensor may be a GPS device that calculates vessel speed by determining how far the vessel has traveled in a given amount of time. The display 20 may comprise part of a user interface system at the vessel helm. In one embodiment, the display 20 may comprise part of an on-board management system for the marine vessel 2, such as a VesselView® by Mercury Marine of Fond Du Lac, Wisconsin. In various embodiments, the display 20 may be a touch screen configured to facilitate user inputs, and/or the display 20 may be incorporated in a user interface system that further includes one or more input devices for facilitating user input, such as a keyboard, push buttons, etc.

Each of the controllers (HCMs, DCMs, etc.) may have a memory and a programmable processor, such as processor 67 and memory 63 in HCM 22. As is conventional, the processor 67 can be communicatively connected to a computer readable medium that includes volatile or nonvolatile memory upon which computer readable code (software) is stored. The processor 67 can access the computer readable code on the computer readable medium, and upon executing the code can send signals to carry out functions according to the methods described hereinbelow. Execution of the code allows the control system 100 to control one or more actuators (for example trim actuators 48*a*, 48*b*) and various other systems in or associated with the marine drives 31, 32. Processor 67 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof. The control system 100 may also obtain data from sensors aboard the vessel (e.g., trim position sensors 36*a* and 36*b*, and the processor 67 may save or interpret the data as described hereinbelow. In the example shown, at least on HCM 22 comprises a memory 63 (such as, for example, RAM or ROM), although all control modules may comprise such storage.

As described above, the system is configured to effectuate a restricted steering angle range for each running marine drive to prevent damage or otherwise undesirable conditions when non-operating marine drives remain trimmed down while the vessel 2 is underway. As described above, such restriction may be accompanied by an instruction to trim up the non-operating marine drive. Upon detecting that all non-operating drives are sufficiently trimmed up, the steering restriction is removed and more steering angle authority is provided to the user. A wide steering angle range is determined for each running marine drive, where the wide steering angle range is wider than the normal steering constraints imposed when all marine drives are trimmed down and operating under normal running conditions. Thus, additional steering authority is provided to the subset of drives that are trimmed down and running, which takes advantage of the extra space afforded when the non-operating drive(s) are trimmed up.

Figure 9A:
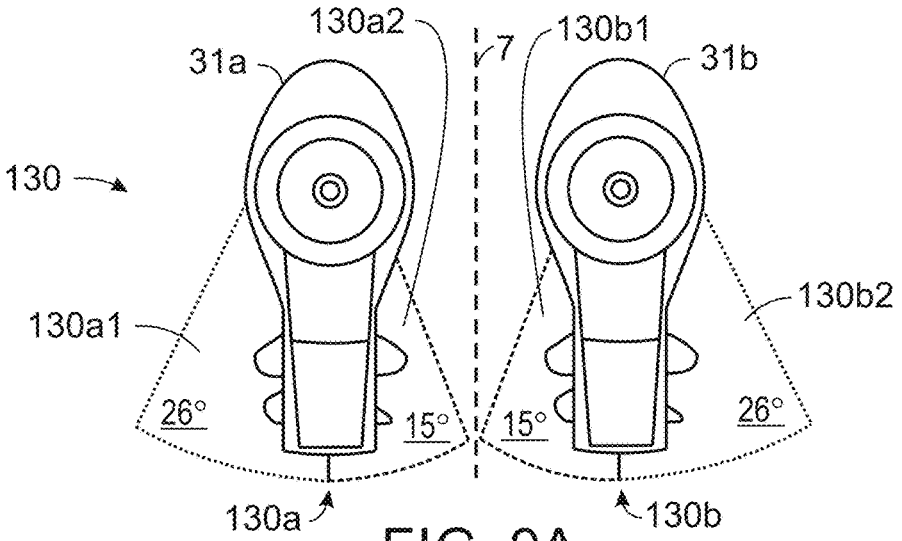
FIGS. 9A-9C and 10A-10C depict marine propulsion systems with one non-operating marine drive, according to some embodiments of the present disclosure.
Figure 9B:
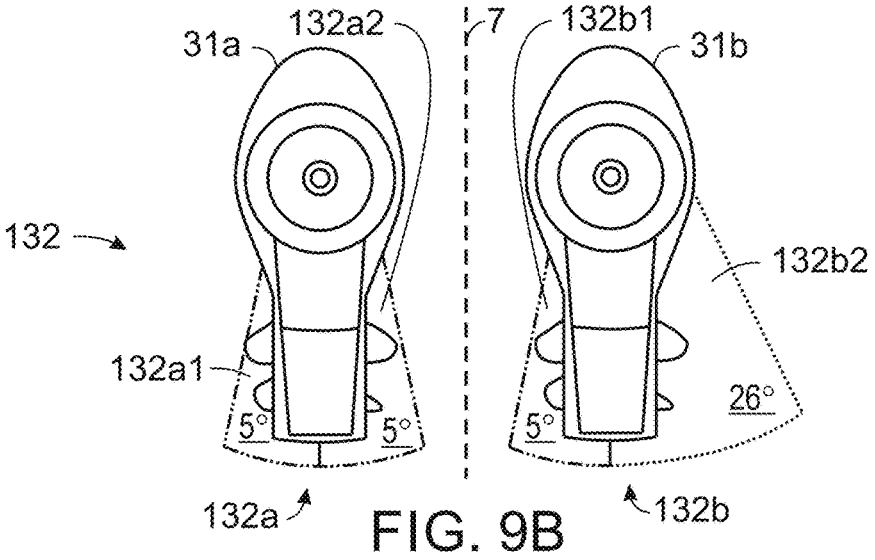
Figure 9C:
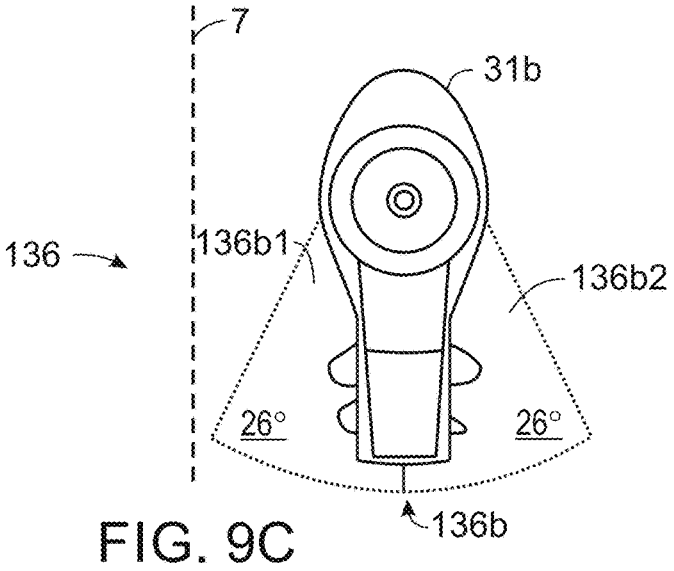

Referring now to FIGS. 9A-9C, steering ranges of a marine propulsion system comprising two drives 31*a* and 31*b* are depicted in three scenarios. FIG. 9A exemplifies a normal permitted steering angle range for each of the two marine drives 31*a* and 31*b* during normal operating conditions where both drives 31*a* and 31*b* are trimmed down and running. FIG. 9B exemplifies a restricted steering angle range for the two marine drives 31*a* and 31*b* when one drive is not running and/or not steerable and is trimmed down and the other is running and trimmed down. FIG. 9C exemplifies a wide steering angle range afforded to the running drive when the non-operating drive is trimmed up such the running drive will not collide with it.

Figure 10A:
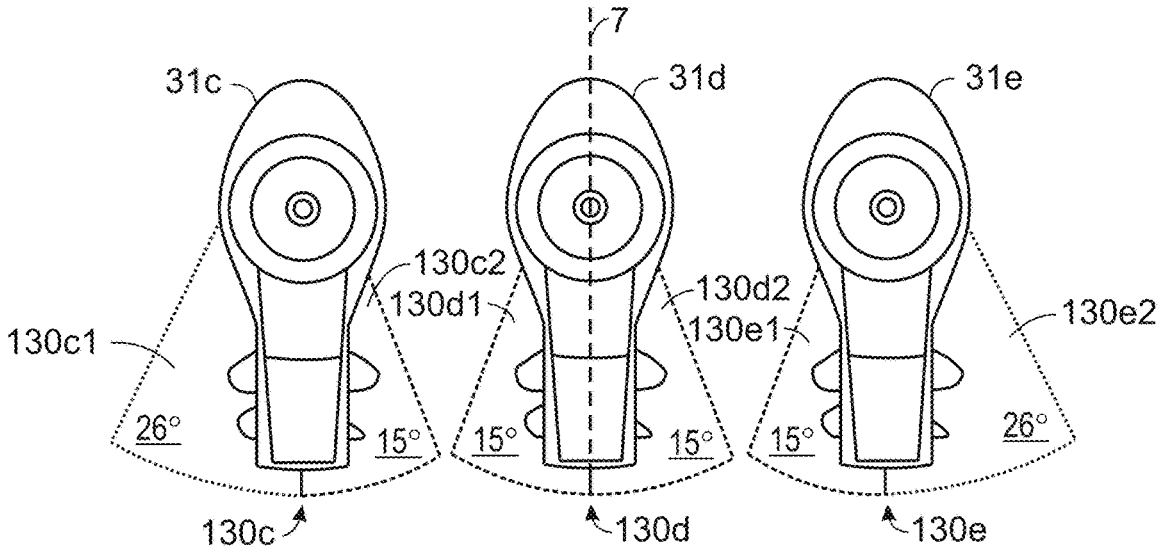
Figure 10B:
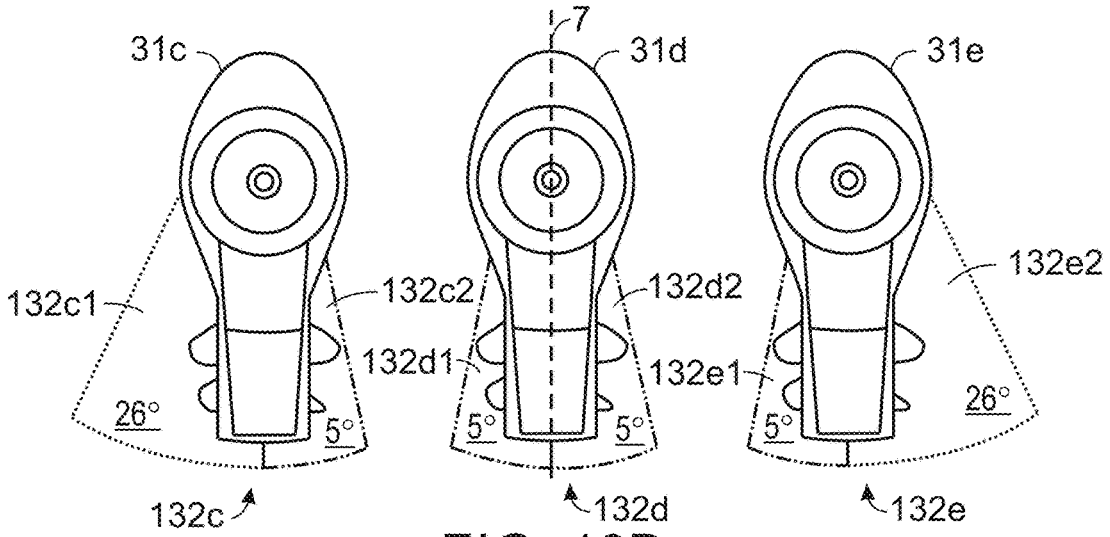
Figure 10C:
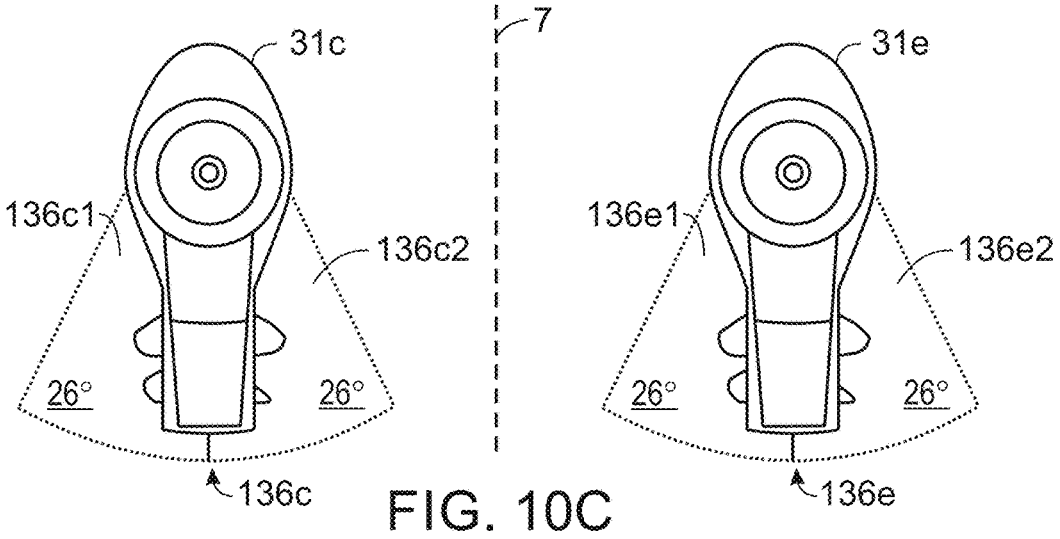

Similarly, FIGS. 10A-OC depict exemplary normal, restricted, and wide steering angle ranges for a three drive arrangement. FIG. 10A exemplifies a normal permitted steering angle range for the three marine drives 31*c*-31*e* during normal operating conditions where all three marine drives 31*c*-31*e* are trimmed down and running. FIG. 10B exemplifies a restricted steering angle range for the three marine drives 31*c*-31*e* when at least one drive is not running or not steerable and is trimmed down and the other(s) is running and trimmed down. FIG. 10C exemplifies a wide steering angle range afforded to the running drive(s) when the at least one non-operating drive(s) is trimmed up such the running drive will not collide with it.

The control system is configured to detect whether each of the marine drives is running or is not operating. Where at least one of the plurality of marine drives is running and at least one of the plurality of marine drives is not operating, logic is executed to determine whether the non-operating marine drive is trimmed up or trimmed down. The control system receives sensed steering position information and trim position information for each marine drive through the sensors and systems described above. Logic is executed to determine whether each marine drive 31*a*, 31*b* is trimmed up out of the way of the other drives or trimmed down such that it poses a collision risk with the other marine drives were they to be steered normally. For example, this determination may be based on comparison to a threshold trim position. The control system is configured to select between the normal steering angle range, the restricted steering angle range, and the wide steering angle range based thereon, and based on which drive(s) is/are running and which one(s) is/are not running, and/or which drive(s) is/are is steerable and which one(s) is/are not steerable.

The threshold trim position may be defined such that the non-operating marine drive is high enough to allow the adjacent marine drive(s) to steer under the non-operating marine drive without collision. Referencing the example in FIGS. 9A-9B, the threshold trim position is defined such that the non-operating drive 31*a* is trimmed high enough such that the adjacent drive 31*b* can be steered underneath it. Referencing the example in FIGS. 10A-10B, the threshold trim position is defined such that the non-operating drive 31*d* is trimmed high enough such that the adjacent drives

31*c* and 31*e* can both be steered underneath it without colliding with any part of the non-operating marine drive 31*d*. To provide just one example, the threshold trim position may be one where some or all of the lower portion of the non-operating drive 31*a*, 31*d* is out of the water, such as position A2 shown in FIG. 7 (or may be higher), and high enough that the adjacent drives can be steered to any steering angle and will not hit the lower end or any other part of the non-operating marine drive. Alternatively or additionally, the threshold trim position may be a threshold value associated with the marine drive being out of the water, such as where no part of the drive is still in the water. Alternatively, the threshold trim position for determining whether the drive is sufficiently trimmed up may be based on a maximum trim position of the marine drive, such as whether the measured trim position of the drive is within a threshold angle range of the maximum trim position.

If a non-operating marine drive(s) is not trimmed up, the control system determines a restricted steering angle range 132 for each of the plurality of marine drives to avoid drive collision between the running marine drive and the at least one non-operating marine drive. Where the non-operating drive(s) is trimmed up, the control system determines a wide steering angle range. The restricted steering angle range is more restrictive than the normal steering angle range and the wide steering angle range, and thus has a smaller maximum steering angle from the centered steering position in at least one steering direction. Conversely, the wide steering angle range is less restrictive in at least one steering direction than the normal steering angle range and the restricted steering angle range, and thus has a larger maximum steering position in at least one steering direction than either of the other two ranges.

Each steering angle range for each marine drive may be defined with reference to a centered steering position, such as when the drive is positioned parallel to the center line 7 of the marine vessel. Each steering angle range includes a clockwise portion where the marine drive is rotated from the centered steering position in a clockwise direction to a maximum allowed steering position in that direction, and a counterclockwise portion where the marine drive is rotated from the centered steering position in a counterclockwise direction to a maximum allowed steering position in that direction.

Each steering angle range may or may not be symmetrical around the centered steering position. Each steering angle range may include different steering angles for each marine drive, such as depending on the position of the marine drive on the transom. For example, the steering angle ranges for an outer drive (e.g., an outer port drive or an outer starboard drive) may be more restricted toward an adjacent drive compared to outward away from the centerline 7 of the marine vessel. Where only two drives are positioned at the rear of the marine drive, both are outer drives. Where three or more drives are positioned at the rear of the marine vessel, the two outermost drives are the outer drives and the remainder constitute the inner drive(s). FIG. 9A depicts exemplary normal steering angle ranges 130 for a two-drive arrangement, including the port and starboard drives 31*a* and 31*b*. The port outer normal steering angle range 130*a* includes a clockwise portion 130*al* and a counterclockwise portion 130*a*2. The starboard outer normal steering angle range 130*b* likewise includes a clockwise portion 130*b*1 and a counterclockwise portion 130*b*2. Here, the normal steering angle ranges are different from one another and are both asymmetrical about the centered steering position. In the port steering angle range 130*a*, the clockwise portion 130*al* (such as the depicted 26 degree steering range in the CW direction) has a greater maximum steering position than the counterclockwise portion 130*a*2 (such as the depicted 15-degree steering range in the CCW direction). The starboard steering angle range 130*b* is the opposite, as shown. The depicted ranges are merely exemplary, and a person of ordinary skill in the art will understand that the normal steering angle ranges may be any predetermined steering angle ranges that provide full steering capability of the vessel while avoiding collisions between the marine drives 31*a*, 31*b*.

FIG. 9B shows the restricted steering angle ranges 132 for the two drive arrangement where a non-operating drive is in a trimmed down position such that it is in the water, which here is the port drive 31*a*. Here, the restricted steering angle range 132*a*, 132*b* is different for each of the marine drives 31*a*, 31*b*, wherein the non-operating drive 31*a* is more restricted than the running marine drive 31*b*. Further, the running marine drive is more restricted in the turning direction toward the non-operating marine drive (portion 132*b*1) to limit the possibility of collision with the non-operating marine drive (which may not have steering function). However, the range in the turning direction away from the non-operating marine drive (portion 132*b*2) is not further restricted from the corresponding constraint of the normal steering angle range. Here, the restricted steering angle range 132*a* for the non-operating marine drive is symmetrical about the centered steering position, whereas the restricted steering angle range 132*b* for the running marine drive is asymmetrical about the centered steering position. In this example, the restricted steering angle range 132*a* for the non-operating marine drive is significantly narrowed about the centered steering position, with each portion 132*al* and 132*a*2 being only 5 degrees in each rotational direction. In other embodiments, the restricted steering angle range for the non-operating marine drive may be narrower or wider than this example, and in still other embodiments, the non-operated marine drive may be held in the centered steering position and not moved at all in response to user steering instructions. The depicted ranges are merely exemplary, and a person of ordinary skill in the art will understand that the restricted steering angle ranges may be any predetermined steering angle ranges that are more restrictive in at least one rotation direction than the normal steering angle ranges. Furthermore, the restricted steering angle ranges may depend on which drive is the non-operating marine drive. Thus, one of several possible restricted steering angle ranges 132 may be chosen and implemented by the control system based on which drive is identified to be non-operating and trimmed down. In other embodiments, the restricted steering angle range 132 may be a uniform value applied to all applicable steering ranges.

If the at least one non-operating marine drive 31*a* is trimmed up, the control system determines and implements a wide steering angle range 136 for each of the running marine drive(s). The wide steering angle range 132 is wider than the restricted steering angle range and/or wider than the normal steering angle range in at least one of the rotation direction for at least one of the drives. Additionally or alternatively, the wide steering angle ranges 132 may be wider in all directions for one or more of the marine drives 31*a*, 31*b* or on one side of each marine drive. In the depicted example, the starboard outer wide steering angle range 136*b* is symmetrical about the centered steering position. In other embodiments, the wide steering angle range 136 may be asymmetrical about the centered steering position. The wide steering angle range 136*b* includes the clockwise portion

136*b*1 and the counterclockwise portion 136*b*2. Here, the clockwise portion 136*b*1 includes an increased maximum steering position of 26 degrees, which is a greater maximum steering position in the clockwise rotation direction than is provided in the restricted steering angle range. It is also a greater maximum steering position in the clockwise rotation direction than is provided in the normal steering angle range. Thereby, the wide steering angle range 136 to provide increased steerability of the marine vessel with the single remaining running drive 31*b*.

FIGS. 10A-10C illustrate steering range determination and control for propulsion systems with three or more marine drives. FIG. 10A illustrates an exemplary normal steering range to be implemented when all marine drives are running and functioning normally. The normal steering angle ranges 130 for the three marine drives include asymmetrical steering angle ranges 130*c* and 130*e* for the outer marine drives 31*c* and 31*e*, where the clockwise portion 130*c*1, 130*e*1 is different than the counterclockwise portion 130*c*2, 130*e*2. For the inner drive 130*d*, the normal steering angle range is symmetrical about the center steering position, where the clockwise portion 130*d*1 is the same as the counterclockwise portion 130*d*2 and both are more restrictive than the outward rotation portions 130*c*1 and 130*e*2 of the outer marine drives 31*c* and 31*e*.

If a non-operating drive 31*d* is detected, then either a restricted steering angle range or a wide steering angle range is implemented, depending on the trim position of the non-operating marine drive. If the non-operating marine drive(s) is trimmed down such that it remains in the water, then a restricted steering angle range 132 (including restricted ranges 132*c*-132*e*) is implemented for each of the plurality of marine drives 31*c*-31*e*. Each of the restricted steering angle ranges 132*c*-132*e* is different from the others and the ranges may depend on the location of the marine drive on the vessel and which of the drives 31*c*-31*e* is the non-operating marine drive. When there is a non-operating drive, at least the adjacent running drive(s) will be more restricted than they were in the normal operating steering ranges. Similar to the restricted steering angle ranges described above, marine drives may be most restricted in the rotational directions toward a non-operating marine drive. Here, the non-operating drive 31*d* is the center drive, and the steering angle range portions 132*c*2 and 132*e*2 proximal to the non-operating drive 31*d* are restricted to a restricted steering angle range, depicted here as five degrees. Both portions 132*d*1 and 132*d*2 of the restricted steering angle range 132*d* of the non-operating marine drive 31*d* are likewise narrowly restricted. In another example, if the port drive 31*c* was the non-operating drive 31*c*, the center drive 31*d* would be restricted in the direction of the non-operating drive, while the starboard drive steering angle range might remain unchanged. Alternatively, the system may be configured that narrower steering angle ranges are implemented for all drives, and thus if the port drive were the non-operating drive then the starboard drive steering angle range may also be restricted in at least one rotational direction. When there is a non-operating drive, at least the adjacent running drive will be restricted.

If the non-operating drive (here drive 31*d*) is trimmed up, the running drives (here 31*c* and 31*e*) are assigned a wide steering angle range, thus allowing increased steerability of the remaining drives. In the wide steering angle ranges 136, which are exemplified in FIG. 10C, each of the running drives is able to steer to a greater maximum steering angle in at least one rotational direction than it was able to in the restricted steering angle range 132 or the normal steering angle range 130. In one embodiment, the wide steering angles may be the same in both rotational directions and for both drives, such that the rotation portions 136*c*1, 136*c*2, 136*e*1, and 136*e*1 are all maximized. The additional space between the running drives 31*c*, 31*e* provided by trimming up the non-operating marine drive 31*d* provides more room for steering than the normal steering angle ranges effectuated when all drives are trimmed down and running. Thus, the wide steering angle range 136 for each of the at least one running marine drive 31*c* and 31*e* extends under the non-operating marine drive 31*d* that is trimmed up.

Similar methods and configurations may be applied to propulsion systems with four or more marine drives, such as the four drive configuration depicted in FIG. 2. In embodiments with two or more non-operating drives, the restricted steering angle ranges may be applied to limit rotation of drives toward a non-operating drive, as well as to limit rotation of the non-operating drive or stop steering rotation of that drive altogether. This limitation on the non-operating drive accounts for the fact that the steering system on that drive may not be functioning properly, as well as to limit the amount of power consumed by the steering actuator of the non-operating drive. In embodiments where a running drive is surrounded on both sides by non-operating drives, such as if the port and starboard marine drives 31*c*, 31*e* were both identified as non-operating drives 31*c*, 31*e*, then the central marine drive 31*d* would have a restricted steering angle range on both its port and starboard sides, until the non-operating drives 31*c*, 31*e* were trimmed up. At this time, the central marine drive, 31*d*, would have a wide steering angle range for both its port and starboard sides, essentially operating as a single marine drive propulsion system.

In some circumstances the trimmed up non-operating marine drive 31*a* may need to be trimmed down, such as for docking in tight spaces where it is undesirable for a drive to remain trimmed up (either for visibility reasons or to decrease the footprint of the vessel). Likewise, trim down may occur in a situation where the user wants to start the non-operating drive, such as where the user was previously operating with just a subset of the drives and now want to engage all drives, such as for high speed propulsion. In some circumstances, a user may desire to trim down a drive while the vessel is underway, which may be while the vessel is operating at planning speeds. However, where the wide steering angle range is being implemented, trimming down the drive that was previously trimmed up risks causing a drive collision where the drive being trimmed down impacts the adjacent drive. Thus, a change in the permitted steering angle range may be needed such that the wide steering angle range is eliminated and instead the normal steering angle range or the restricted steering angle range is implemented. However, if the marine drive is being operated at speed, it may be undesirable to automatically implement a change in the permitted steering angles that would cause a sudden change in the steering positions of the drives and/or a sudden change in the way that the drives respond to steering commands (such as a change in the ratio of steering wheel rotation to drive rotation.

Accordingly, to avoid the risk of collision between the marine drives and damage to the marine vessel and/or marine drives and to avoid implementing sudden steering changes while the vessel is underway, the control system may be configured to limit trimming down a trimmed up drive unless and until certain conditions are met. Thus, the control system may deactivate or block trim down demands for the non-operating marine drive 31*a* unless and until a predetermined set of criteria are met. In some such embodiments where the marine vessel includes a "trim all" command that normally changes trim in an up or down direction for all drives, the "trim all" command will only change trim of the running marine drives unless the predetermined set of criteria are met. For example, the predetermined criteria for trimming down a non-operating drive once the wide steering angle range is implemented may include speed restrictions (such as a vessel speed and/or an RPM threshold) and steering position thresholds for the drive(s) adjacent to the one that is being trimmed down.

In response to receiving an instruction to trim down a non-operating marine drive (e.g. 31*a* or 31*d* in the two examples), the control system may prevent trim down of the non-operating marine drive 31*a* if any running marine drive 31*b* adjacent to the non-operating marine drive 31*a* is steered to a position within the wide steering angle range that is under the trimmed up non-operating marine drive 31*a*. For example, the control system may be configured to determine if the adjacent marine drive is in a steering position in the direction of the non-operating marine drive that is greater than a threshold steering position. The comparison between the steering range (or measured steering position) of the running drive 31*b* and the steering position of the non-operating drive 31*a* is executed to verify that trimming down the non-operating drive will not cause a collision. Alternatively, the restricted steering angle ranges may be implemented to guarantee that the drives cannot be in a position where collision is possible. Additionally, the control system may be further configured to prevent trim down of the non-operating drive 31*a* if the non-operating marine drive (or any marine drive) has a steering sensor fault. A steering sensor fault may mean that the steering position of the non-operating drive cannot be reliably determined and thus logic for avoiding drive collision during trim down cannot be executed.

Alternatively or additionally, the control system may be further configured to prevent trim down of a non-operating drive 31*a* when the marine vessel is above a threshold speed parameter, such as a threshold vessel speed (e.g., measured speed over ground or speed over water) and/or when any of the marine drives are running above a threshold drive RPM. This prevents changing the steering operation of the running marine drives while the vessel is underway at speeds where changes in the steering control regime may be undesirable. Alternatively or additionally, a different speed-related parameter may be used to determine whether the vessel is operating at a low speed or idle speed where changes in the steering control regime would be acceptable, such as a threshold helm demand, a threshold throttle position, a gear position (such as only implementing changes where all running drives are in neutral), and/or any threshold value directly or indirectly related to propulsion speed. Referring again to FIG. 4, in certain embodiments, the speed condition and corresponding speed threshold is a transmission speed, such as a transmission output speed, measured from the transmission 51*a*, 51*b* of each drive 31, 32. For example, the transmission speed may be measured by a transmission output speed sensor (TOSS).

Figure 11:
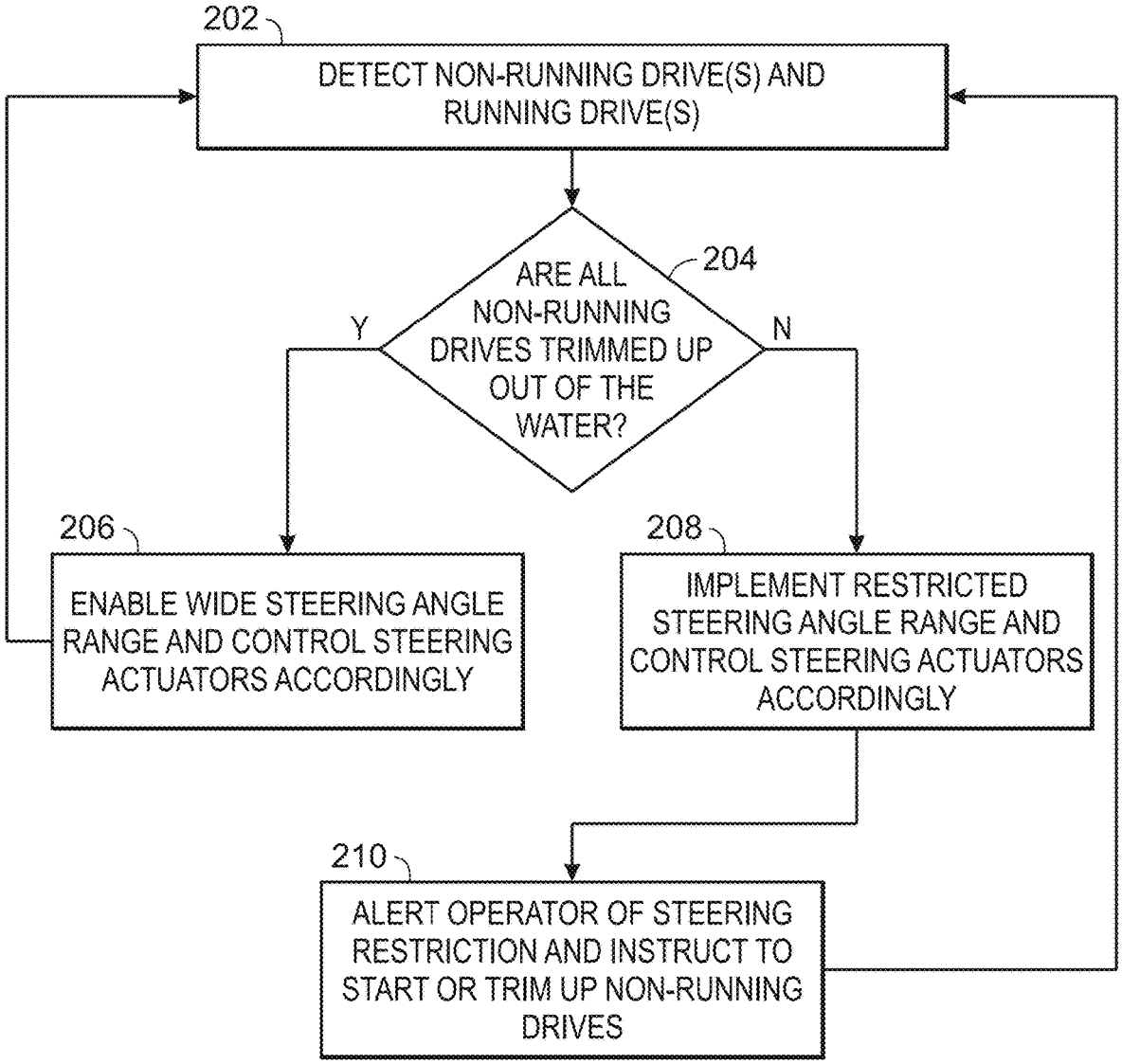
FIGS. 11 and 12 depict exemplary method steps for controlling the marine propulsion system including the detection of at least one non-operating drive.

Referring now to FIG. 11, exemplary method steps for controlling steering in accordance with the present disclosure are illustrated. At step 202, the control system detects at least one non-operating marine drive(s) and at least one running marine drive(s). At step 204, the control system executes logic to determine if all the non-operating drive(s) are trimmed up out of the water. In one embodiment, a measured trim position of the non-operating marine drive is compared to a threshold trim position defined to ensure that the non-operating marine drive is high enough to allow an adjacent marine drive to steer under the non-operating marine drive without collision. Alternatively or additionally, the threshold trim position may be defined such that, above the threshold, the marine drive is out of the water (e.g., a trim position above which the marine drive is fully out of the water). Alternatively or additionally, the measured trim position is compared to a threshold trim position that is based on a maximum trim position of the marine drive, such as to determine whether the trim position of the non-operating drive is within a threshold of the maximum trim position indicating that the non-operating drive is fully trimmed up or is near the maximum trim position in which case it would be fully out of the water. If the non-operating drive(s) are trimmed up, then at step 206 the control system enables wide steering angle and control steering actuators for the running drive(s) accordingly. If not, then at step 208, the control system implements a restricted steering range and control steering actuators accordingly.

In one embodiment, determining the restricted steering angle range for each of the plurality of marine drives includes determining a different range for each of the plurality of marine drives based on the position of each respective marine drive on the marine vessel—e.g., its starboard/port inner/outer position. Additionally or alternatively, the restricted steering angle range for each of the plurality of marine drives includes a port outer restricted steering angle range for the port outer drive and a starboard outer restricted steering angle range for the starboard outer drive. In one embodiment, the port outer restricted steering angle range and the starboard outer restricted steering angle range are different from one another and at least one of the port outer restricted steering angle range and the starboard outer restricted steering angle range are asymmetric about a centered steering position, such as where the drives are more restricted in one rotational direction than the other.

At step 210, the control system alerts the operator of the steering restriction and/or instructs to start or trim up the detected non-operating drive(s). The control system returns to step 202 and continues to implement the restricted steering angle ranges until the non-operating drive is trimmed up (at which point the wide steering angle range can be implemented) or is turned on (at which point the normal steering angle range can be implemented). In some embodiments, an alert may also be generated after implementing the wide steering angle range, such as to notify the user that trim restrictions are in place that may prevent trimming the non-operating drive back down.

Figure 12:
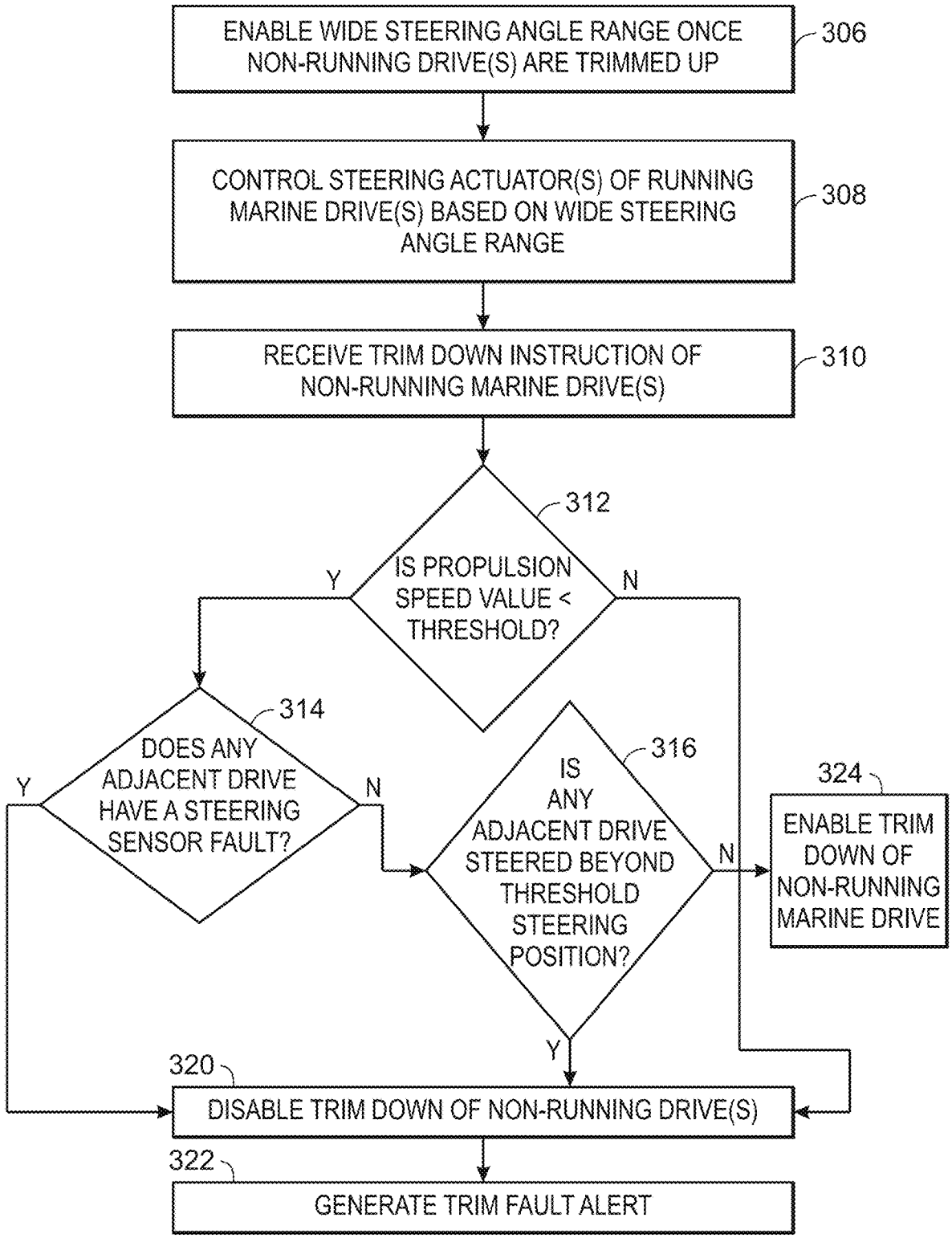

Referring now to FIG. 12, method steps for controlling trim and steering in the wide steering angle range regime are illustrated. At step 306, the control system enables a wide steering angle range once the non-operating drive(s) are trimmed up. In one embodiment, the wide steering angle range for each of the at least one running marine drive is based on a starboard or port position of the non-operating marine drive(s) on the stern of the marine vessel and the number of drives on the marine vessel. At step 308, the control system controls the steering actuator(s) of the running marine drive(s) based on the wide steering angle range. Thus, the running drives are steered to a maximum steering position that may be under the adjacent non-operating marine drive that is trimmed up.

At step 310, the control system receives trim down instruction of the at least one non-operating marine drive. Upon receiving the instruction, at step 312, the control system determines if the propulsion speed value is less than a threshold. In some embodiments, the propulsion speed value may include the vessel speed, RPM, gear position, throttle position, or demand, as examples. If the propulsion speed value is not less than a threshold then, at step 320, the control system disables trim down of the non-operating drives such that the trim position of the non-operating drive will not change in response to user input to adjust trim or in response to any other trim change command. If the propulsion speed value is less than a threshold then, at step 314, the control system determines if any adjacent drive to the non-operating marine drive has a steering sensor fault. If there is an adjacent drive with a sensor fault then, at step 320, the control system disables trim down of the non-operating drives. If there is not an adjacent drive with a sensor fault then, at step 316, the control system determines if there is any adjacent drive steered beyond a threshold steering position such that it is under the non-operating marine drive or otherwise poses a collision risk if the non-operating drive were to be trimmed down.

If there is not an adjacent drive steered beyond such a threshold steering position and all other conditions are also met then, at step 324, the control system enables trim down of the non-operating marine drive(s). If there is an adjacent drive that is steered beyond such a threshold steering position then, at step 320, the control system disables trim down of non-operating drive(s). At step 322, the control system generates a trim fault alert. In one embodiment, the trim fault alert indicates that trim down of the non-operating drives is disabled.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A marine propulsion system for a marine vessel comprising:

a plurality of marine drives;

a control system communicatively connected to the plurality of marine drives and configured to:

detect that at least one of the plurality of marine drives is running and that at least one of the plurality of marine drives is not operating, wherein not operating includes not running and/or not steerable;

detect a trim position of each of the at least one non-operating marine drive;

determine whether the at least one non-operating marine drive is trimmed up based on whether the detected trim position is greater than a threshold trim position, wherein the threshold trim position is defined such that the non-operating marine drive is high enough to allow an adjacent marine drive to steer under the non-operating marine drive without collision;

if the at least one non-operating marine drive is not trimmed up, determine a restricted steering angle range for each of the plurality of marine drives to avoid drive collision between the running marine drive and the at least one non-operating marine drive;

if the at least one non-operating marine drive is trimmed up, determine a wide steering angle range for each of the at least one running marine drive; and control a steering actuator for each of the plurality of marine drives based on the restricted steering angle range or the wide steering angle range for the respective marine drive.

2. The system of claim 1, wherein the detected trim position is based on a maximum trim position of the non-operating marine drive.

3. The system of claim 1, wherein determining the restricted steering angle range for each of the plurality of marine drives includes determining a different range for each of the plurality of marine drives based on a starboard or port position of each respective marine drive.

4. The system of claim 1, wherein the restricted steering angle range for each of the plurality of marine drives includes a port outer restricted steering angle range for a port outer drive and a starboard outer restricted steering angle range for a starboard outer drive.

5. The system of claim 4, wherein the port outer restricted steering angle range and the starboard outer restricted steering angle range are different from one another and at least one of the port outer restricted steering angle range and the starboard outer restricted steering angle range are asymmetric about a centered steering position.

6. The system of claim 4, wherein the port outer restricted steering angle range is more restrictive in a counterclockwise rotation direction than a clockwise rotation direction, wherein the starboard outer restricted steering angle range is more restrictive in the clockwise rotation direction than the counterclockwise rotation direction.

7. The system of claim 1, wherein the restricted steering angle range and the wide steering angle range for each of the at least one running marine drive is based on a starboard or port position of the at least one non-operating marine drive on a stern of the marine vessel and a number of drives on the marine vessel.

8. The system of claim 1, wherein the wide steering angle range is wider than the restricted steering angle range in at least one rotation direction.

9. The system of claim 8, wherein the wide steering angle range for each of the at least one running marine drive extends under the at least one non-operating marine drive that is trimmed up.

10. The system of claim 1, wherein the control system is further configured to control a trim actuator to prevent trim down of a non-operating marine drive when the marine vessel is above a threshold vessel speed and/or when any of the marine drives are above a threshold drive RPM.

11. The system of claim 1, wherein the control system is configured to, in response to receiving an instruction to trim down the at least one non-operating marine drive, control a trim actuator to prevent trim down of the at least one non-operating marine drive if any adjacent running marine drive to the at least one non-operating marine drive is steered to a position within the wide steering angle range that is under the at least one non-operating marine drive.

12. The system of claim 11, wherein the control system is further configured to control a trim actuator to prevent trim down of the at least one non-operating marine drive if any adjacent marine drive to the at least one non-operating marine drive has a steering sensor fault.

13. A method of controlling a plurality of marine drives on a marine vessel, the method comprising:

detecting that at least one of the plurality of marine drives is running and that least one of the plurality of marine drives is not operating, wherein not operating includes not running and/or not steerable;

detecting a trim position of each of the at least one non-operating marine drive;

determining whether the at least one non-operating marine drive trimmed up based on whether the detected trim position is greater than a threshold trim position, wherein the threshold trim position is defined such that the non-operating marine drive is high enough to allow an adjacent marine drive to steer under the non-operating marine drive without collision;

if the at least one non-operating marine drive is not trimmed up, determining a restricted steering angle range for each of the plurality of marine drives to avoid drive collision between the running marine drive and the at least one non-operating marine drive;

if the at least one non-operating marine drive is trimmed up, determining a wide steering angle range for each of the at least one running marine drive; and controlling a steering actuator for each of the plurality of marine drives based on the restricted steering angle range or the wide steering angle range for the respective marine drive.

14. The method of claim 13, wherein the threshold trim position is defined such that the non-operating marine drive is trimmed out of the water.

15. The method of claim 13, wherein determining the restricted steering angle range for each of the plurality of marine drives includes determining a different range for each of the plurality of marine drives based on a starboard or port position of each respective marine drive.

16. The method of claim 13, wherein the restricted steering angle range and the wide steering angle range for each of the at least one running marine drive is based on a position of the at least one non-operating marine drive on the marine vessel and a number of drives on the marine vessel.

17. The method of claim 13, wherein the wide steering angle range is wider than the restricted steering angle range in at least one rotation direction, wherein the wide steering angle range for each of the at least one running marine drive extends under the at least one non-operating marine drive that is trimmed up.

18. The method of claim 13, further comprising controlling a trim actuator to preventing trim down of a non-operating marine drive when the marine vessel is above a threshold vessel speed and/or when any of the marine drives are above a threshold drive RPM.

19. The method of claim 13, further comprising, in response to receiving an instruction to trim down the at least one non-operating marine drive, controlling at trim actuator to prevent trim down of the at least one non-operating marine drive if any adjacent marine drive to the at least one non-operating marine drive is steered to a position within the wide steering angle range that is under the at least one non-operating marine drive or if any adjacent marine drive to the at least one non-operating marine drive has a steering sensor fault.

20. A marine propulsion system for a marine vessel comprising:

a plurality of marine drives;

a control system communicatively connected to the plurality of marine drives and configured to:

detect that at least one of the plurality of marine drives is running and that at least one of the plurality of marine drives is not operating, wherein not operating includes not running and/or not steerable;

detect a trim position of each of the at least one non-operating marine drive;

determine, based on the trim position, whether the at least one non-operating marine drive is trimmed up;

if the at least one non-operating marine drive is not trimmed up, determine a restricted steering angle range for each of the plurality of marine drives to avoid drive collision between the running marine drive and the at least one non-operating marine drive, wherein determining the restricted steering angle range for each of the plurality of marine drives includes determining a different range for each of the plurality of marine drives based on a starboard or port position of each respective marine drive;

if the at least one non-operating marine drive is trimmed up, determine a wide steering angle range for each of the at least one running marine drive; and control a steering actuator for each of the plurality of marine drives based on the restricted steering angle range or the wide steering angle range for the respective marine drive.

* * * * *